US005927253A

United States Patent [19]

Oyafuso et al.

[11] Patent Number: 5,927,253

[45] Date of Patent: Jul. 27, 1999

[54] FUEL SYSTEM PRIMING METHOD

[75] Inventors: Kevin Gregory Oyafuso, Allen Park; Robert Timothy Trzeciak, Southgate; William Eugene Nixon, Sterling Heights, all of Mich.

[73] Assignee: Ford Global Technologies, Inc., Dearborn, Mich.

[21] Appl. No.: 09/030,877

[22] Filed: Feb. 26, 1998

[51] Int. Cl.[6] ..... F02M 55/00; F02M 69/00

[52] U.S. Cl. ..... 123/456; 123/457; 123/497; 123/516

[58] Field of Search ..... 123/456, 457, 123/459, 461, 491, 497, 516

[56] References Cited

U.S. PATENT DOCUMENTS

| | | | |
|---|---|---|---|
| Re. 34,803 | 12/1994 | Chasteen | 123/73 C |
| 3,789,819 | 2/1974 | Moulds | 123/516 |
| 4,079,717 | 3/1978 | Shirose | 123/516 |
| 4,449,359 | 5/1984 | Cole et al. | 60/39.094 |
| 4,602,599 | 7/1986 | Glagola | 123/179.9 |
| 4,691,680 | 9/1987 | Staerzl | 123/491 |
| 4,732,131 | 3/1988 | Hensel | 123/516 |
| 5,408,975 | 4/1995 | Blakeslee et al. | 123/491 |
| 5,454,359 | 10/1995 | Howell | 123/516 |
| 5,579,738 | 12/1996 | Frischmuth et al. | 123/497 |
| 5,633,458 | 5/1997 | Pauli et al. | 73/119 A |
| 5,692,479 | 12/1997 | Ford et al. | 123/514 |

*Primary Examiner*—Tony M. Argenbright
*Attorney, Agent, or Firm*—Donald A. Wilkinson

[57] ABSTRACT

A fuel system priming method for an internal combustion engine having a returnless fuel system and electronic fuel injection includes sensing fuel pressure rate of rise during priming. The fuel pump is first activated to pressurize the system and then the injectors are controlled for a short interval in response to the sensed rate of pressure rise to vent trapped air in the fuel system. The fuel pump is then activated again to pressurize the fully primed fuel system for quick engine starting.

20 Claims, 2 Drawing Sheets

FUEL SYSTEM PRIMING METHOD

FIELD OF THE INVENTION

The present invention relates to fuel priming methods for returnless fuel systems of internal combustion engines.

BACKGROUND OF THE INVENTION

During the manufacture of an automobile at an assembly plant, end of line tests are used as quality control measures. Typically, end of line tests include a first start as an overall engine system check. The time to complete a first start is critical for maximizing production capabilities and producing cost competitive products. The fuel priming step in the assembly process is used to fill the fuel lines and fuel rails of the fuel system with fuel so that the first start of the vehicle will be quick and efficient. Without priming the fuel system, the starter must turn the engine for an unnecessarily long time while the fuel system purges trapped air before delivering fuel.

Conventional fuel priming methods used for fuel delivery systems containing a return line simply turn on the fuel pump for a certain time interval. Turning on the fuel pump delivers fuel up to the fuel rail and trapped air is sent back to the fuel tank via the return line. Thus, when a vehicle is first started after priming, the start time is minimized. However, incomplete fuel system priming occurs when the vehicle contains a returnless fuel system. Returnless fuel systems do not contain a return line or relief valve which, when using conventional priming methods, are necessary for releasing trapped air during the fuel priming step of the assembly process. Thus, during a first start, the starter must continually turn the engine until the trapped air is passed through the cylinders and exhaust system, resulting in significant starting delays. Priming methods are known where trapped air in a fuel delivery system is vented into the engines combustion chamber. One method uses a bypass valve to allow trapped air to circumvent a normal flow path and enter the engine burn chamber. Such a system is disclosed in the U.S. Pat. No. 4,449,359.

The inventors herein have recognized numerous disadvantages with the above approaches. One disadvantage is the necessity of additional hardware to create an alternate flow path as in the case of U.S. Pat. No. 4,449,359. Using this system for vehicles is disadvantageous because the cost of additional hardware to solve a problem that only occurs during the first start at an assembly plant is unacceptable. A second disadvantage is that circumstance may occur where fuel is accidentally injected into the engine in an attempt to vent trapped air. Accidental injection of fuel can cause the vehicle to experience a long first start, can cause the vehicle to fail end of line emissions tests, and can cause hydraulic locking of the engine requiring costly and time consuming repairs.

Consideration of a system that monitors absolute fuel pressure in an attempt to assist in the control of venting trapped air has been made. However, the inventors herein have recognized that this approach is susceptible to the problems previously described. For example, in typical fuel delivery systems absolute pressure does not have any correlation to the amount of air trapped in the fuel delivery system. Further, systems which monitor absolute pressure do not provide any information to determine the proper amount of purge time.

SUMMARY OF THE INVENTION

An object of the invention claimed herein is to provide a method for priming a fuel delivery system of an internal combustion engine having a returnless fuel system thereby allowing for a minimal first start time.

The above object is achieved, and problems of prior approaches overcome, by providing a fuel system priming method for priming a returnless fuel system of a fuel injected internal combustion engine while the engine is off and an electronic control system is on. In one particular aspect of the invention, the method comprises the steps of commanding a fuel pump on for a first predetermined interval, sensing a rate of pressure rise during said first predetermined interval, comparing the sensed rate of pressure rise with a predetermined rate of pressure rise, and controlling a plurality of fuel injectors for a second predetermined interval in response to the rate of pressure rise comparison.

By allowing air trapped in the fuel delivery system to vent into the engine combustion chamber only when the rate of pressure rise in the fuel delivery system falls within predetermined limits, accidental venting of fuel into the engine combustion chamber may be avoided. For example, if the vehicle has for some reason already been primed, the pressure rate of rise will be higher than expected because the compressibility of the fuel is significantly higher than the compressibility of air. Thus, accidental injection of fuel into the engine combustion chamber is avoided. Alternatively, if the fuel system has a leak, the fuel rate of rise will be lower than expected because air and fuel may be escaping from the system. Thus, the priming process may be aborted.

An advantage of the above aspect of the invention is that a returnless fuel system can be properly primed while avoiding accidental fuel injection and diagnosing faulty systems.

Another advantage of the above aspect of the invention is that a vehicle containing a returnless fuel system can be quickly started on a first start during an end of line test.

Yet another advantage of the above aspect of the invention is that assembly plant production and efficiency are not compromised by vehicles containing a returnless fuel system.

Other objects, features and advantages of the present invention will be readily appreciated by the reader of this specification.

BRIEF DESCRIPTION OF THE DRAWINGS

The invention will now be described, by way of example, with reference to the accompanying drawings, in which.

DESCRIPTION OF THE PREFERRED EMBODIMENTS

Figure 1:
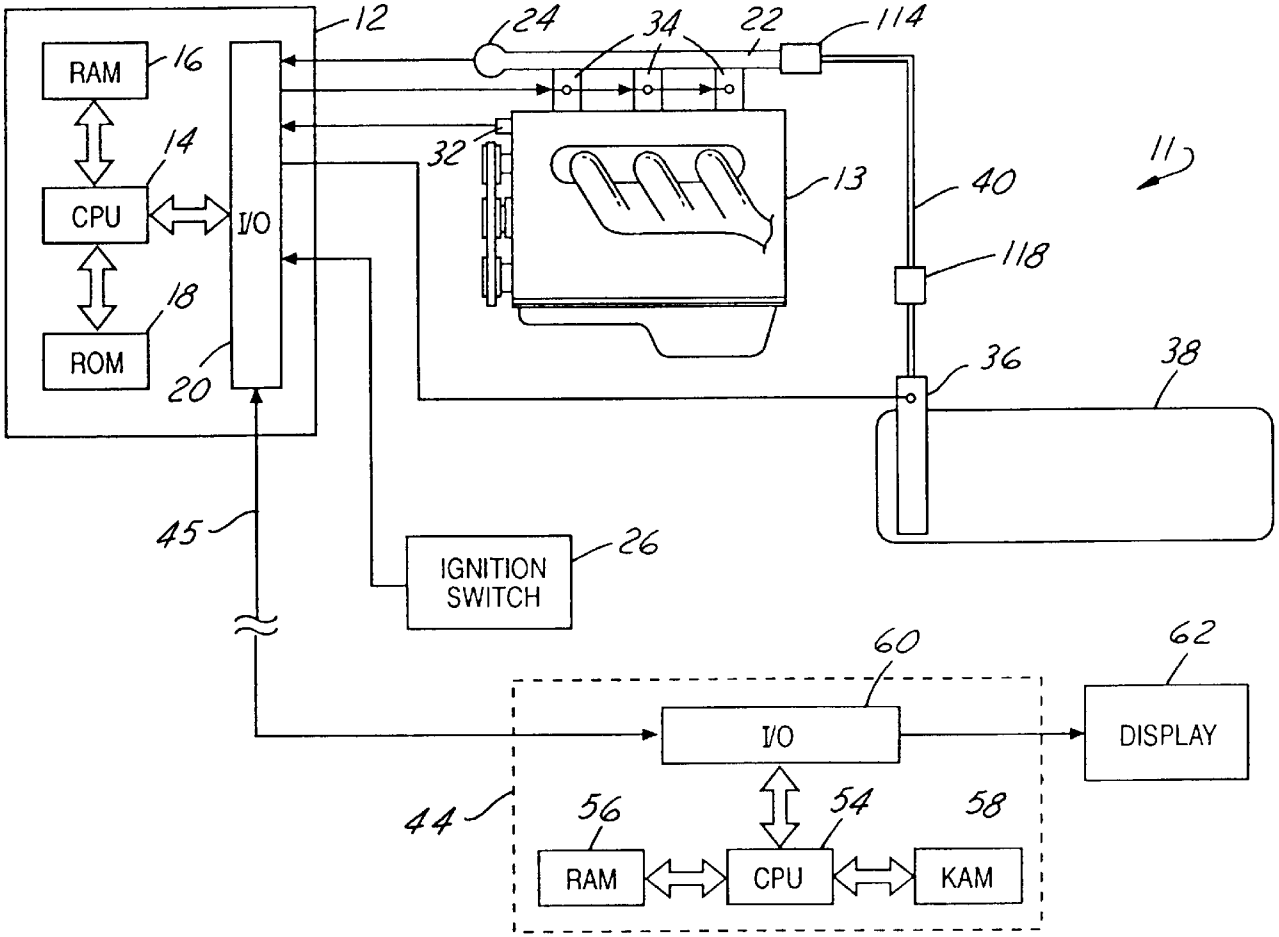
FIG. 1 is a block diagram of an engine and a returnless fuel system in which the invention is used to advantage.

Electronically controlled returnless fuel delivery system 11, shown in FIG. 1, of an automotive internal combustion engine 13 is controlled by controller 12, such as an EEC or PCM. Engine 13 comprises fuel injectors 34, which are in fluid communication with fuel rail 22 to inject fuel into the cylinders (not shown) of engine 13, and temperature sensor 32 for sensing temperature of engine 13. Electronically controlled returnless fuel delivery system 11 has fuel rail 22, fuel rail pressure sensor 24 connected to fuel rail 22, fuel line 40 coupled to fuel rail 22 via coupling 114, fuel filter 118, a fuel holding means such as fuel tank 38, and electronically controlled fuel delivery control means 36 to selectively deliver fuel from fuel tank 38 to fuel rail 22 via fuel line 40. In this example, fuel tank 38 houses fuel delivery control means 36.

Controller 12 has CPU 14, random access memory 16, computer storage medium (ROM), 18 having a computer readable code encoded therein, which is an electronically programmable chip in this example, and input/output (I/O) bus 20. Controller 12 controls engine 13 by receiving various inputs through I/O bus 20 such as fuel pressure in fuel deliver system 11, as sensed by pressure sensor 24; the position of ignition switch 26; and, temperature of engine 13. Controller 12 also senses various outputs through I/O bus 20 to actuate the various components of the electronically controlled returnless fuel delivery system 11 . Such components include fuel injectors 34 and fuel delivery control means 36. It should be noted that the fuel may be liquid fuel, in which case fuel delivery means 36 is an electronic fuel pump. Alternatively, according to the present invention, the fuel may be gaseous fuel, in which case fuel delivery control means 36 is a solenoid valve and fuel rail 22 is a fuel supply manifold.

Controller 12 also communicates with fuel priming controller 44 when connected by an operator during the assembly process via link 45. Fuel priming controller 44 is capable of sending and receiving signals from controller 12, which include sending a signal to controller 12 to operate fuel injectors 34. Fuel priming controller 44 has CPU 54, random access memory 56, computer storage medium (ROM) 58, having a computer readable code encoded therein, which is an electronically programmable chip in this example, and input/output (I/0) bus 60. Further, fuel priming controller 44 is capable of communicating with fuel priming display 62 to indicate proper fuel priming, proper communication, fuel priming abort, and fuel system type as will be described hereinafter.

Alternatively, as would be apparent to one of ordinary skill in the art in view of this disclosure, controller 12 may posses all of the capabilities and programming of fuel priming controller 44, thereby eliminated fuel priming controller 44.

Fuel delivery control means 36, upon demand from engine 13 and under control of controller 12, pumps fuel from fuel tank 38 through fuel line 40, and into high pressure fuel rail 22 for distribution to the fuel injectors during conventional steady state operation. Controller 12 records fuel rail pressure as sensed by sensor 22 and controls fuel delivery control means 36 to maintain a desired fuel rail pressure. In returnless fuel delivery systems, fuel within tank 38 enters fuel delivery control means 36 through an inlet where it is pumped up to a higher pressure and exits of fuel delivery control means 36. The fuel then enters fuel line 40 after passing through fuel filter 118. Then, the fuel enters fuel rail 24 where is controlled by fuel injectors 34.

Figure 2B:
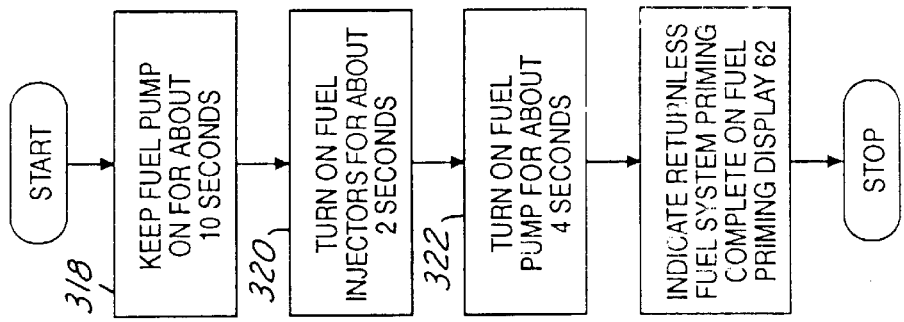
FIGS. 2A and 2B are flowcharts of various operations according to the present invention.
Figure 2A:
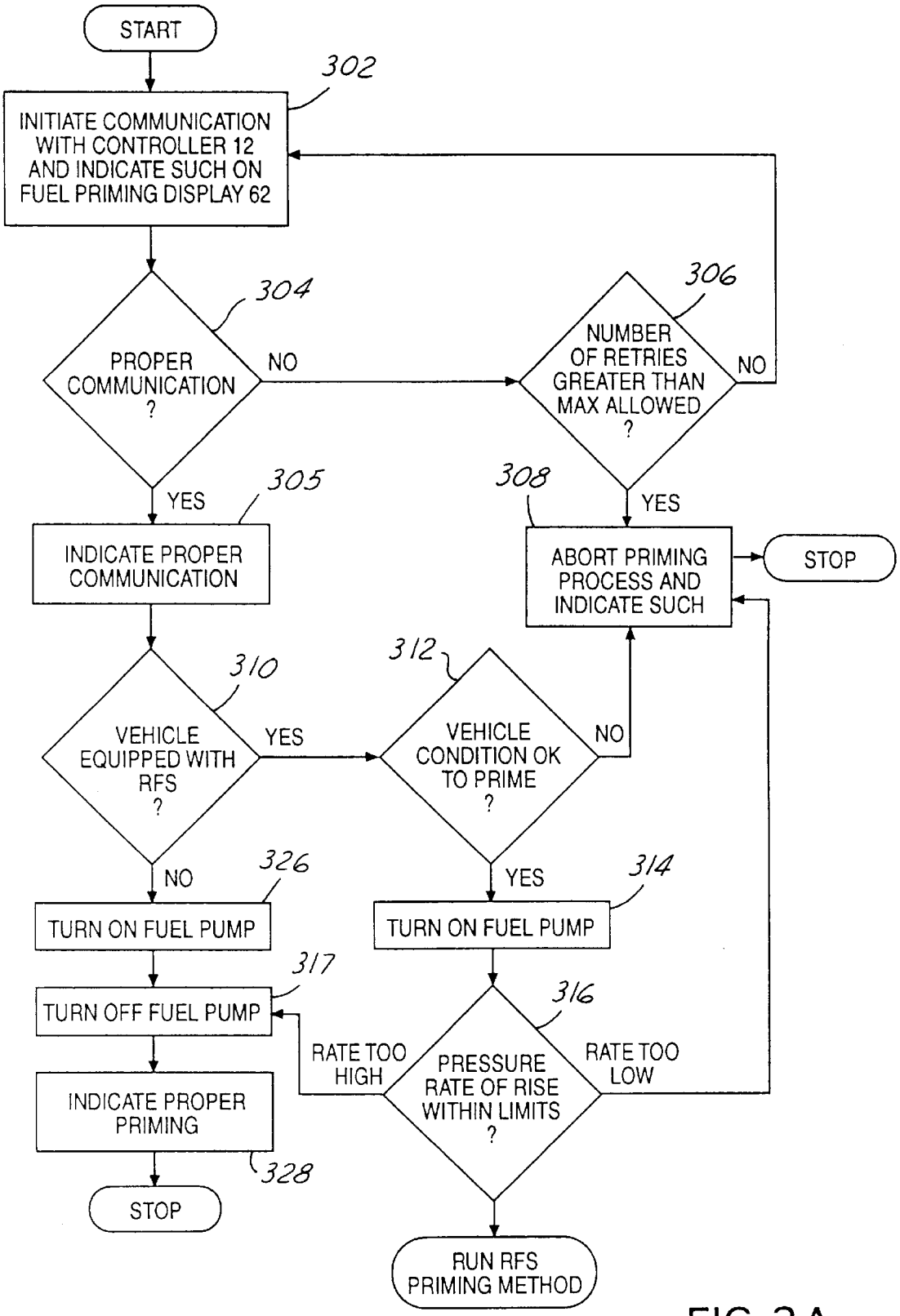

According to the present invention, as shown in FIGS. 2A and 2B, the routine executed by fuel priming controller 44 for priming a vehicle having either a returnless or return type fuel delivery system is now described. As shown in FIG. 2A, During step 302, fuel priming controller 44 initiates communication with controller 12 and correspondingly indicates such on fuel priming display 62. In step 304, when proper communication has been established, fuel priming controller 44 appropriately illuminates fuel priming display 62 in step 305. When communication cannot be established (step 304) fuel priming controller 44 repeats attempts to communicate with controller 12 until a maximum number has been reached, in which case the fuel priming process is aborted and fuel priming controller 44 appropriately illuminates fuel priming display 62 (step 306 and 308).

Continuing with FIG. 2A, after proper communication has been established, at step 310 fuel priming controller 44 determines if the vehicle is equipped with a returnless fuel system (RFS). When a returnless fuel system is present, at step 312 fuel priming controller 44 checks several vehicle conditions, such as whether the transmission is in park, whether engine 13 is running, and whether controller 12 is still on. When any of these conditions is not as expected, fuel priming controller 44 aborts the fuel priming process and appropriately illuminates fuel priming display 62 as in step 308. When all of these conditions are as expected, fuel priming controller 44, in step 314, commands controller 12 to turn on the fuel pump. According to the present invention, if the fuel pressure rate of rise during step 316 is lower than a predetermined low value, fuel priming controller 44 aborts the fuel priming process and appropriately illuminates fuel priming display 62 as in step 308. If the fuel pressure rate of rise is higher than a predetermined high value, fuel priming controller 44 commands controller 12 to turn off the fuel pump in step 317. If the fuel pressure rate of rise is between the low value and the high value, fuel priming controller 44 executes returnless fuel priming method subroutine as shown in FIG. 2B to command controller 12 in step 318 to keep the fuel pump on for a first predetermined interval which, in a preferred embodiment, is about 10 seconds. This pressurizes the fuel and air in electronically controlled returnless fuel delivery system 11. Then, during step 320, fuel priming controller 44 commands controller 12 to open a predetermined number of injectors for a second predetermined interval, which, in a preferred embodiment, is about 2 seconds. By opening a predetermined number of injectors, possibilities of accidental injection are minimized. Further, by opening injectors, a path is created for trapped air to escape electronically controlled returnless fuel delivery system 11. This allows fuel to fully occupy electronically controlled returnless fuel delivery system 11. Then, during step 322 fuel priming controller 44 commands controller 12 to turn on the fuel pump for a third predetermined interval, which, in a preferred embodiment, is about 4 seconds. It is necessary to reactivate the fuel pump to recover the pressure loss in the fuel in electronically controlled returnless fuel delivery system 11 due to the opening of the injectors. Then, during step 324 fuel priming controller 44 indicates complete priming of the returnless fuel system by appropriately illuminating fuel priming display 62.

Alternatively, as shown in FIG. 2A, if at step 310 fuel priming controller 44 determines that the vehicle does not have a returnless fuel system, at step 326, the fuel pump is commanded on for a fourth predetermined interval which, in a preferred embodiment, is about 16 seconds. This pressurized the fuel in the return fuel system and releases trapped air. Then, at step 317, the fuel pump is turned off. Then, during step 328, fuel priming controller 44 indicates complete priming of the return fuel system by appropriately illuminating fuel priming display 62.

This concludes the description of the Preferred Embodiment. The reading of it by those skilled in the art would bring to mind many alterations and modifications without departing from the spirit and scope of the invention.

Accordingly, it is intended that the scope of the invention be limited by the following claims.

We claim:

1. A fuel system priming method for priming a returnless fuel system of a fuel injected internal combustion engine while said engine is off and an electronic control system is on, the method comprising the steps of:

commanding a fuel pump on for a first predetermined interval;

sensing a rate of pressure rise during said first predetermined interval;

comparing the sensed rate of pressure rise with a predetermined rate of pressure rise; and controlling a plurality of fuel injectors for a second predetermined interval in response to said comparison.

2. The fuel system priming method recited in claim 1 wherein said step of sensing further comprises the step of sensing a rate of a fuel rail pressure rise during said first predetermined interval.

3. The fuel system priming method recited in claim 1 wherein said controlling step further comprises the step of commanding said fuel pump on for a third predetermined interval, to attain a desired fuel pressure for engine starting.

4. The fuel system priming method recited in claim 1 wherein said controlling step further comprises the step of opening said plurality of fuel injectors for said second predetermined interval in response to said comparison.

5. The fuel system priming method recited in claim 1 wherein said second predetermined interval is a function of the sensed rate of pressure rise.

6. The fuel system priming method recited in claim 1 wherein said first predetermined interval is about 10 seconds.

7. The fuel system priming method recited in claim 1 wherein said second predetermined interval is about 2 seconds.

8. The fuel system priming method recited in claim 1 wherein said comparing step further comprises the step of determining whether the sensed rate of pressure rise is within a predetermined range of pressure rate of rise parameters.

9. A fuel priming system for performing a priming operation on a returnless fuel system of a fuel injected internal combustion engine while said engine is off and an electronic control module is on, the returnless fuel system comprising:

a plurality of fuel injectors in communication with the engine for supplying fuel to the engine;

a fuel rail in communication with said injectors;

a fuel pump to deliver fuel to said fuel rail;

a pressure sensor in communication with said fuel rail for sensing pressure in said returnless fuel system; and a fuel priming controller in communicating with said electronic engine control module for commanding said fuel pump on for a first predetermined interval; sensing a rate of pressure rise during said first predetermined interval; comparing the sensed rate of pressure rise with a predetermined rate of pressure rise; and controlling a plurality of fuel injectors for a second predetermined interval in response to said comparison.

10. The fuel priming system recited in claim 9 wherein said fuel priming controller further commands said fuel pump on for a third predetermined interval.

11. The fuel priming system recited in claim 9 wherein said fuel priming controller further controls said plurality of fuel injectors open for said second predetermined interval in response to said comparison.

12. The fuel priming system recited in claim 9 wherein said first predetermined interval is about 10 seconds.

13. The fuel priming system recited in claim 9 wherein said second predetermined interval is about 2 seconds.

14. The fuel priming system recited in claim 9 wherein said fuel priming controller further determines whether the sensed rate of pressure rise is within a predetermined range of pressure rate of rise parameters.

15. The fuel priming system recited in claim 9 wherein said second predetermined interval is a function of the sensed rate of pressure rise.

16. A controller adapted to be connected to an electronic engine controller of a vehicle having an engine, the electronic engine controller adapted to communicate with a fuel rail pressure sensor of a returnless fuel system, a fuel pump of a returnless fuel system, and a plurality of fuel injectors in fluid communication with the engine, the returnless fuel system for delivering fuel to the plurality of fuel injectors, said controller comprising:

a computer comprising a central processing unit, a random access memory, and an input/output bus;

a computer storage medium having a computer readable code encoded therein adapted to send a signal to the electronic engine controller for commanding the fuel pump on for a first predetermined interval, adapted to receive from the electronic engine controller a signal representing a rate of fuel rail pressure rise during first predetermined interval, comparing said sensed rate of pressure rise with a predetermined rate of pressure rise, and adapted to send a signal to the electronic engine controller for commanding a predetermined number of the plurality of fuel injectors on for a second predetermined interval in response to said comparison; and a display for indicating execution of the computer readable code.

17. The controller as described in claim 16 wherein said computer storage medium further comprises a computer readable code adapted to send a signal to the electronic engine controller for commanding the fuel pump on for a third predetermined interval.

18. The controller as described in claim 16 wherein said computer storage medium further comprises a computer readable code for adjusting said second predetermined interval in response to the sensed rate of pressure rise.

19. The controller as described in claim 16 further comprising a user interface adapted to receive signal from a user.

20. The controller as described in claim 16 wherein said computer storage medium is an electronically programmable chip.

* * * * *